US011738555B2

(12) United States Patent
Ishida et al.

(10) Patent No.: US 11,738,555 B2
(45) Date of Patent: Aug. 29, 2023

(54) LIQUID EJECTION HEAD AND METHOD FOR MANUFACTURING LIQUID EJECTION HEAD

(71) Applicant: CANON KABUSHIKI KAISHA, Tokyo (JP)

(72) Inventors: Yuzuru Ishida, Kanagawa (JP); Yoshinori Misumi, Tokyo (JP); Maki Kato, Tokyo (JP); Takeru Yasuda, Kanagawa (JP); Tsubasa Funabashi, Oita (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 133 days.

(21) Appl. No.: 17/367,793

(22) Filed: Jul. 6, 2021

(65) Prior Publication Data

US 2022/0016886 A1 Jan. 20, 2022

(30) Foreign Application Priority Data

Jul. 14, 2020 (JP) ..... 2020-120678

(51) Int. Cl.
*B41J 2/14* (2006.01)
*B41J 2/16* (2006.01)

(52) U.S. Cl.
CPC ..... *B41J 2/14016* (2013.01); *B41J 2/14145* (2013.01); *B41J 2/1601* (2013.01); *B41J 2/164* (2013.01); *B41J 2/1606* (2013.01); *B41J 2/1628* (2013.01); *B41J 2/1631* (2013.01);

(Continued)

(58) Field of Classification Search
CPC .. B41J 2/14016; B41J 2/14145; B41J 2/1601; B41J 2/1606; B41J 2/1628; B41J 2/1631; B41J 2/164; B41J 2/1642; B41J 2/1646; B41J 2/1404; B41J 2/1603
See application file for complete search history.

(56) References Cited

U.S. PATENT DOCUMENTS 10,286,664 B2 * 5/2019 Terasaki ..... B41J 2/14145
10,669,628 B2 6/2020 Fukumoto et al.
11,001,062 B2 5/2021 Teranishi et al.
(Continued)

FOREIGN PATENT DOCUMENTS

JP 2018-187789 A 11/2018

*Primary Examiner* — Yaovi M Ameh
(74) *Attorney, Agent, or Firm* — VENABLE LLP

(57) ABSTRACT

A liquid ejection head includes a liquid ejection head substrate having ejection elements that generate liquid ejecting energy, an ejection port formation member having ejection ports, and liquid chambers between the liquid ejection head substrate and the ejection port formation member to house liquid to be ejected through the ejection ports. The liquid ejection head substrate includes a substrate, an insulating film stacked on the substrate to insulate the ejection elements, communication ports in the substrate and the insulating film to communicate with the liquid chambers, and a liquid-resistant insulating film adherent to the ejection port formation member. The liquid-resistant insulating film covers the insulating film at its ejection port formation member side and includes a first portion partially contacting the ejection port formation member and a second portion covering the inner surfaces of the communication ports in the insulating film, the first and second portions being continuous.

20 Claims, 6 Drawing Sheets

(52) U.S. Cl.
CPC ..... *B41J 2/1642* (2013.01); *B41J 2/1646* (2013.01); *B41J 2/1404* (2013.01); *B41J 2/1603* (2013.01)

(56) References Cited

U.S. PATENT DOCUMENTS

| | | | | |
|---|---|---|---|---|
| 11,081,349 | B2 | 8/2021 | Uyama et al. | |
| 2016/0039206 | A1* | 2/2016 | Usui | B41J 2/14129 216/49 |
| 2017/0341390 | A1* | 11/2017 | Kanri | B41J 2/1631 |
| 2018/0244043 | A1* | 8/2018 | Tsutsui | B41J 2/1646 |
| 2018/0281414 | A1* | 10/2018 | Fukumoto | B41J 2/1631 |

* cited by examiner

LIQUID EJECTION HEAD AND METHOD FOR MANUFACTURING LIQUID EJECTION HEAD

BACKGROUND OF THE INVENTION

Field of the Invention

The present invention relates to a liquid ejection head that ejects liquid and a method for manufacturing the liquid ejection head.

Description of the Related Art

There are liquid ejection heads that form liquid chambers by having an ejection port formation member in which ejection ports are formed provided on one surface of a liquid ejection head substrate provided with ejection elements (hereinafter referred to as an ejection element substrate) and that are configured to eject liquid in the liquid chambers from the ejection ports by driving the ejection elements. For use in a liquid ejection head of this type, there is known an ejection element substrate having an interlayer insulating film stacked on a silicon substrate to insulate components such as the ejection elements and electric wiring connected thereto. Supply ports and liquid channels to supply liquid to the liquid chambers are formed in the interlayer insulating film and the silicon substrate. Also, to suppress erosion by liquid, a liquid-resistant film may be formed on the face of the ejection element substrate that comes into contact with liquid. Depending on the type of the liquid such as ink, a silicon oxide (SiO) film used as an interlayer insulating film particularly has the risk of being eroded by liquid, and thus it is desirable that the surface of contact with liquid be covered with a liquid-resistant film.

Japanese Patent Laid-Open No. 2018-187789 discloses an ejection element substrate in which the surface of the interlayer insulating film of the ejection element substrate is covered with an insulating film that has a good adhesive property with respect to the ejection port formation member and in which the inner surfaces of the supply ports communicating with the ejection ports are covered with a liquid-resistant film using atomic layer deposition (ALD).

SUMMARY OF THE INVENTION

In the manufacturing of the ejection element substrate in Japanese Patent Laid-Open No. 2018-187789, an insulating film which is liquid-resistant and has an adhesive property with respect to the ejection port formation member is formed on the surface of the interlayer insulating film provided on the silicon substrate, and then, supply ports and liquid channels to communicate with the liquid chambers are formed. Next, using ALD, a liquid-resistant film such as a titanium oxide (TiO) film is formed on the insulating film and the inner surfaces of the supply flow channels. Further, the film on the region outside the supply ports is removed by etching. This etching is performed such that overlap portions between the film formed by ALD and the insulating film may be left by a width of several micrometers around the opening portions of the supply ports. The formation of the overlap portions makes it possible to help prevent liquid such as ink from intruding into the interlayer insulating film.

As described, the ejection element substrate disclosed in Japanese Patent Laid-Open No. 2018-187789 needs to have film overlaps formed around the supply ports as described earlier in order to help prevent intrusion of liquid into the interlayer insulating film. This calls for a large area around the supply ports, which may increase the overall area of the element substrate.

The present invention provides a liquid ejection head including a liquid ejection head substrate provided with an ejection element that generates energy for ejecting liquid, an ejection port formation member in which an ejection port through which to eject liquid is formed, and a liquid chamber which is formed between the liquid ejection head substrate and the ejection port formation member and houses liquid to be ejected through the ejection port, the liquid ejection head substrate comprising: a substrate; an insulating film stacked on the substrate to insulate the ejection element; a communication port formed in the substrate and the insulating film in such a manner as to communicate with the liquid chamber; and a liquid-resistant insulating film that has an adhesive property with respect to the ejection port formation member, covers a surface of the insulating film at a side where the ejection port formation member is provided, and includes a first portion which is partially in contact with the ejection port formation member and a second portion which covers an inner surface of the communication port formed in the insulating film, the first and second portion being provided in such a manner as to be continuous with each other.

The present invention can provide a reliable liquid ejection head capable of reducing erosion by liquid while suppressing upsizing.

Further features of the present invention will become apparent from the following description of exemplary embodiments with reference to the attached drawings.

DESCRIPTION OF THE EMBODIMENTS

Embodiment

An embodiment of the present invention is described below with reference to the drawings. It should be noted, however, that the following description is not intended to limit the scope of the present invention.

Figure 1:
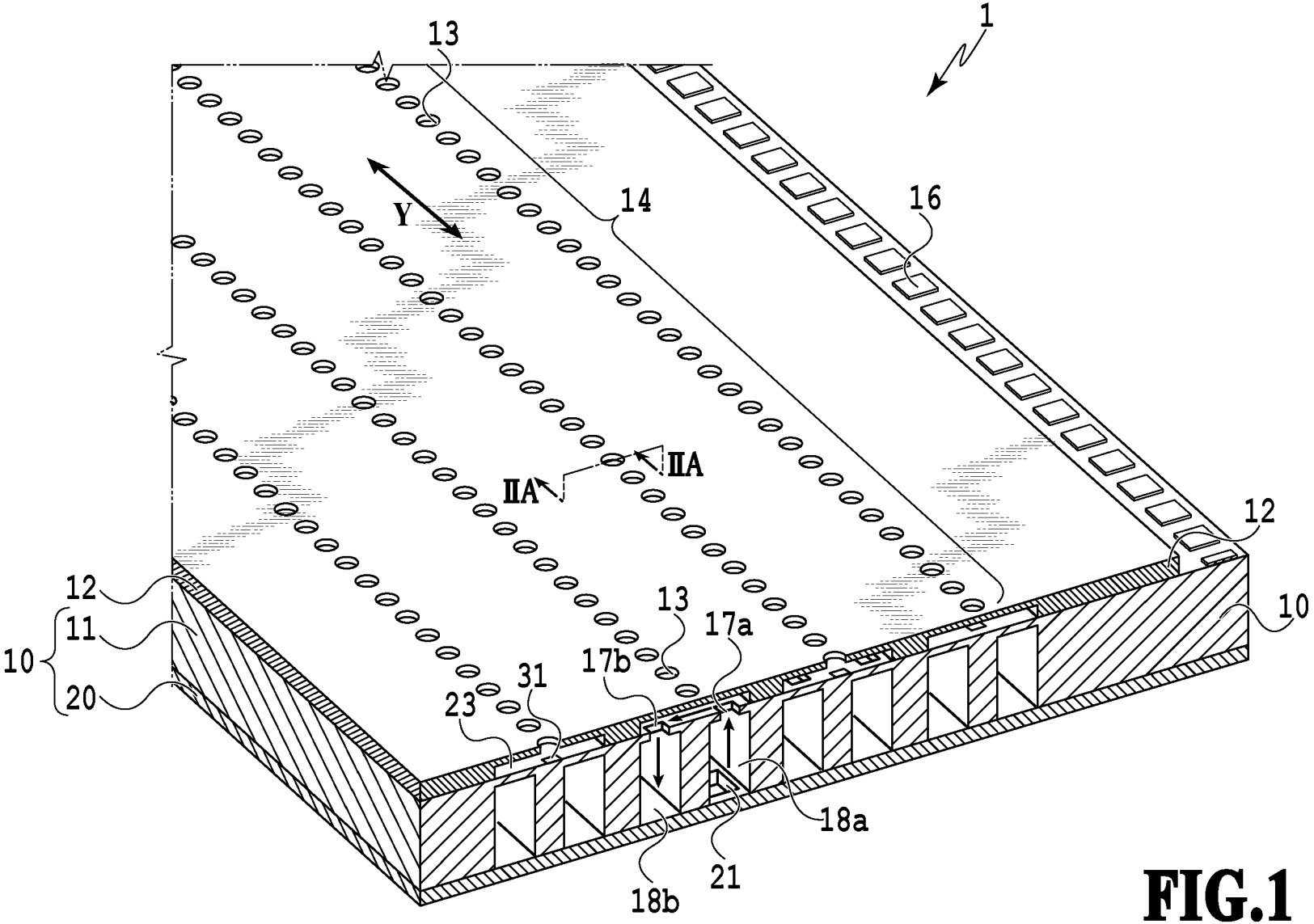
FIG. 1 is a sectional perspective view schematically showing a liquid ejection head according to an embodiment.

FIG. 1 is a sectional perspective view schematically showing a liquid ejection head 1 according to an embodiment of the present invention. The liquid ejection head 1 includes a liquid ejection head substrate (hereinafter also referred to as an ejection element substrate) 10 and an ejection port formation member 12 provided on the front surface side (the upper surface side in FIG. 1) of the ejection element substrate 10. The ejection element substrate 10 has components such as a substrate 11 made of silicon (Si) and a cover plate 20 provided on the back surface side (the lower surface side in FIG. 1) of the substrate 11. Formed on the front surface side of the substrate 11 are, for example, ejection elements 31 as ejection elements that generate ejection energy for ejecting liquid, electric wiring (not shown) connected to the ejection elements 31, and an interlayer insulating film (not shown in FIG. 1). Four ejection port rows 14 corresponding to the respective ink colors are formed in the ejection port formation member 12. Note that the direction in which a plurality of ejection ports 13 constituting each ejection port row 14 are arranged, i.e., the direction in which the ejection port rows extend (Y-direction) is also referred to as an "ejection port row direction."

As shown in FIG. 1, the ejection elements 31 are disposed at positions facing the respective ejection ports 13. Each ejection element 31 is formed by a heat generating element for causing bubbles in liquid with heat energy. By the ejection port formation member 12, pressure chambers (liquid chambers) 23 having the corresponding ejection elements 31 inside are formed compartmentally between the ejection port formation member 12 and the substrate 11. Liquid to be ejected through the ejection port 13 is housed in the pressure chamber 23. The ejection elements 31 are electrically connected to electrode pad portions 16 by the electric wiring (not shown) provided to the ejection element substrate 10. The electrode pad portions 16 are connected to a wiring substrate (not shown) provided outside the ejection element substrate 10. The ejection element 31 generates heat based on a pulse signal inputted from the outside via the wiring substrate and causes the liquid in the pressure chamber 23 to boil. In response to the pressure exerted on the liquid by the boiling, the liquid is ejected through the ejection port 13.

Liquid supply flow channels 18*a* and liquid collection flow channels 18*b* formed in the ejection element substrate 10 are flow channels extending in the ejection port row direction (the Y-direction). Each liquid supply flow channel 18*a* and each liquid collection flow channel 18*b* communicate with the pressure chambers 23 via individual supply ports 39*a* and individual collection ports 39*b* (see FIGS. 2A and 2B), respectively. Each pressure chamber 23 communicates with the corresponding ejection port 13.

Figure 2A:
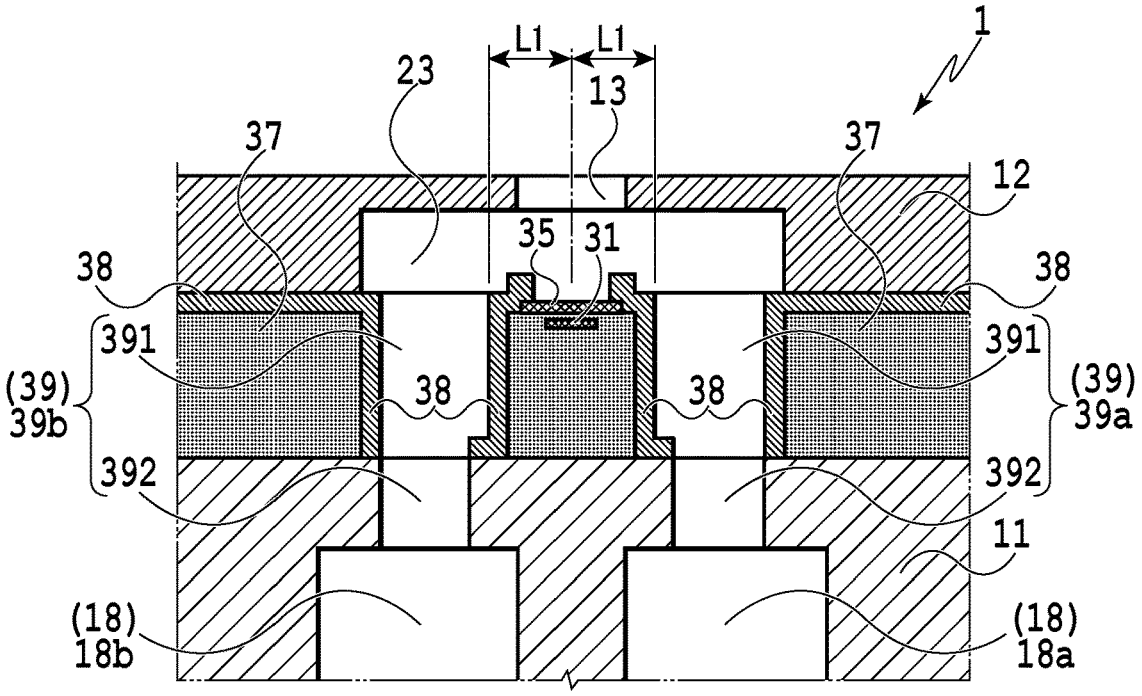
FIGS. 2A and 2B are a partial sectional view and a partial plan view, respectively, of the liquid ejection head shown in FIG. 1.
Figure 2B:
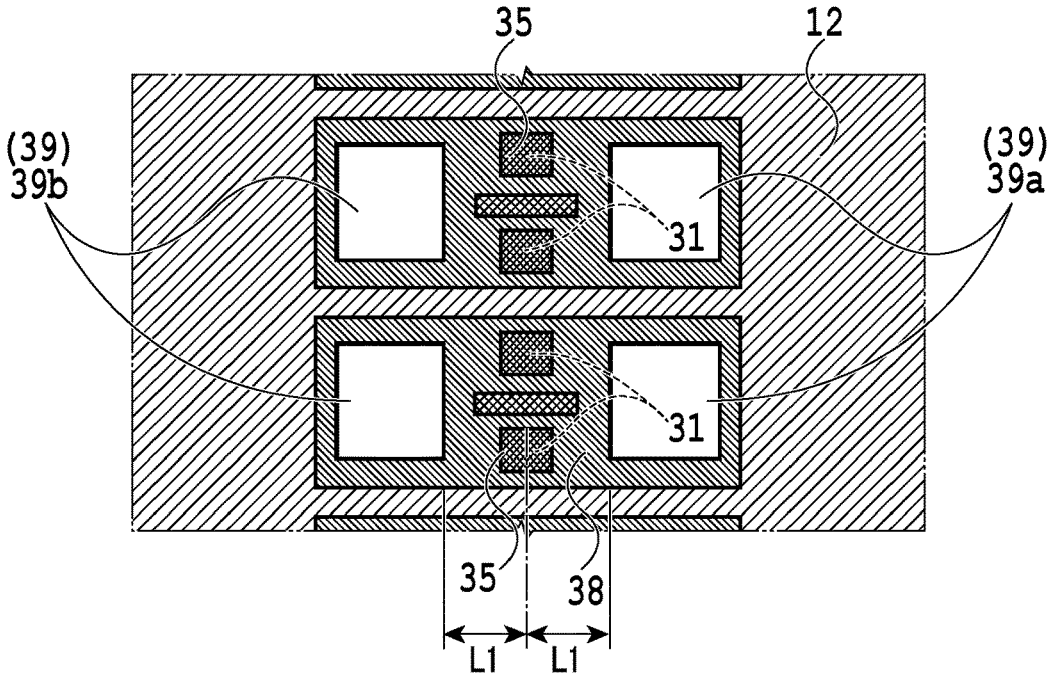

FIG. 2A is a sectional view of the liquid ejection head substrate (ejection element substrate) 10 shown in FIG. 1, taken along the line IIa-IIa, and shows the configuration around the ejection element 31 disposed at a position facing the ejection port 13. FIG. 2B is a plan view of the configuration around the ejection elements 31 seen from the front surface side (the ejection port 13 side).

The configuration of the ejection element substrate 10 according to the present embodiment is described below using FIGS. 2A and 2B. An interlayer insulating film (insulating film) 37 is formed on the front surface side of the substrate 11 (the upper surface side in FIG. 2A). In this interlayer insulating film 37, a circuit formed by electric wiring made of aluminum (Al) or the like is provided. At the front surface side of the interlayer insulating film 37, the ejection elements 31 are formed, which are made of a cermet material such as tantalum silicon nitride (TaSiN) or tungsten silicon nitride (WSiN). The ejection elements 31 are electrically connected to the electric wiring provided in the interlayer insulating film 37 via electrode plugs (not shown) made of tungsten. Further, an insulating protection film (not shown) made of silicon nitride (SiN), silicon carbonitride (SiCN), or a stack thereof is formed to cover the ejection elements 31. A cavitation-resistant layer 35 having a material such as tantalum (Ta) or iridium (Ir) as its outermost surface layer is formed on the surface of the insulating protection film.

In the ejection element substrate 10, the individual supply port 39*a* and the individual collection port 39*b* are formed at both sides of the ejection elements 31 as communication ports communicating with the pressure chamber 23. The individual supply port 39*a* provided on one side of the ejection elements 31 communicates with the liquid supply flow channel 18*a* formed from the back surface side (the lower surface side in FIG. 2A) of the substrate 11. The individual collection port 39*b* provided on the other side of the ejection elements 31 communicates with the liquid collection flow channel 18*b* formed from the back surface side of the substrate 11. In the following description, the individual supply port 39*a* and the individual collection port 39*b* are collectively referred to as individual ports 39 unless they need to be distinguished from each other. Also, the liquid supply flow channel 18*a* and the liquid collection flow channel 18*b* are collectively referred to as liquid flow channels 18 unless they need to be distinguished from each other.

The individual ports 39 each include an opening portion 391 formed in the interlayer insulating film 37 provided on the substrate 11 and an opening portion 392 formed in the substrate 11. These opening portions 391, 392 are each formed by dry etching performed from the front surface side of the substrate 11.

The ejection port formation member 12 made of resin is provided on the front surface of the ejection element substrate 10 in such a manner as to adhere to the front surface (the upper surface in FIG. 2A) of the ejection element substrate 10. The pressure chamber 23 is formed between the ejection port formation member 12 and the front surface of the ejection element substrate 10, communicating with the individual ports 39.

In the above liquid ejection head 1 having the ejection element substrate 10 and the ejection port formation member 12, the ejection element substrate 10 and the ejection port formation member 12 need to adhere to each other favorably. It is also necessary to reduce the risk of the interlayer insulating film 37 inside the individual ports 39 being eluted by coming into contact with liquid such as ink. Thus, the present embodiment is configured such that a liquid-resistant insulating film 38 (a coating film) continuously covers the surface of the ejection element substrate 10 and the inner surfaces of the individual ports 39 formed in the interlayer insulating film 37, except for portions above the ejection elements 31 and the electrode pad portions 16 (see FIG. 1). Thus, the ejection port formation member 12 is in direct contact with the liquid-resistant insulating film 38. Note that a portion of the liquid-resistant insulating film 38 that covers the surface of the interlayer insulating film 37 which is at the side where the ejection port formation member 12 is provided and that is therefore in contact with the ejection port formation member 12 is also referred to as a first portion of the liquid-resistant insulating film 38. Also, a portion of the liquid-resistant insulating film 38 that covers the inner surfaces of the individual ports 39 formed in the interlayer insulating film 37 is also referred to as a second portion of the liquid-resistant insulating film 38. The liquid-resistant insulating film 38 is provided in such a manner that the first portion and the second portion are continuous with each other.

In the present embodiment, the liquid-resistant insulating film 38 is formed of silicon carbonitride (SiCN), silicon oxycarbonitride (SiOCN), silicon oxycarbide (SiOC), or a stack film thereof. Thus, the liquid-resistant insulating film 38 can protect the interlayer insulating film 37 from liquid, including ink. Furthermore, since SiCN, SiOCN, and SiOC exhibit a good adhesive property with respect to the ejection port formation member 12, the liquid-resistant insulating film 38 also functions as an adhesion improvement layer.

In the present embodiment, by containing a carbon atom C, the liquid-resistant insulating film 38 can have liquid resistance. From the perspective of liquid resistance, the liquid-resistant insulating film 38 preferably contains 5 at. % or greater carbon atoms C. It is also preferable that the liquid-resistant insulating film 38 has higher liquid resistance against liquid such as ink than the interlayer insulating film 37.

In the present embodiment, as long as the liquid-resistant insulating film 38 is a silicon compound such as, for example, SiCN, SiOCN, or SiOC, the liquid-resistant insulating film 38 can exhibit a good adhesive property with respect to the ejection port formation member 12, which is made of resin. Also, as to the adhesive property of the liquid-resistant insulating film 38, the liquid-resistant insulating film 38 is preferably joined to the ejection port formation member 12 more strongly than the interlayer insulating film 37 does.

Thus, the present embodiment can achieve a simpler manufacturing process than a comparative example to be described later, in which an adhesion improvement layer formed on the surface of an interlayer insulating film and a liquid-resistant film formed inside individual ports are formed separately. In the comparative example to be described later, an overlap portion which is an overlap between the liquid-resistant film and the adhesion improvement film needs to be formed around each individual port, which is a factor in increasing the distance between the individual port and the ejection element 31. By contrast, in the present embodiment, the liquid-resistant insulating film is continuously formed, and therefore the overlap portions formed in the comparative example are unnecessary. Thus, the present embodiment makes it possible to have a shorter distance between each individual port and the ejection elements 31 than in the comparative example and therefore to make the liquid ejection head 1 compact. Owing to the short distance between each individual port 39 and the ejection elements 31, liquid flow resistance in the liquid ejection head 1 can be reduced. Furthermore, since no consideration needs to be taken as to forming overlap portions, the design flexibility for the liquid ejection head 1 improves.

The liquid ejection head 1 in the present embodiment has a configuration which is used for a liquid ejection apparatus using the liquid circulation method. Specifically, the liquid supply flow channel 18*a* and the liquid collection flow channel 18*b* of the liquid ejection head 1 are respectively connected to an apparatus-side supply flow channel and an apparatus-side collection flow channel provided in the liquid ejection apparatus. Then, liquid in a liquid storage part of the liquid ejection apparatus is supplied to the liquid supply flow channel 18*a* of the liquid ejection head 1 via the apparatus-side supply flow channel, and liquid that has flowed into the liquid supply flow channel 18*a* passes through the individual supply port 39*a* and flows into the pressure chamber 23. Part of the liquid that has flowed into the pressure chamber 23 is ejected from the ejection port 13 by driving of the ejection element 31, and the rest of the liquid returns to the liquid storage part via the individual collection port 39*b*, the liquid collection flow channel 18*b*, and the apparatus-side collection flow channel. Such a liquid-circulating liquid ejection apparatus that ejects liquid while circulating liquid can reduce sedimentation of a color material and the like contained in the liquid and therefore maintain favorable liquid ejection performance. Also, in the above embodiment, a distance L1 from the individual supply port 39*a* to the ejection elements 31 and a distance L1 from the individual collection port 39*b* to the ejection elements 31 are shortened. Thus, flow resistance that liquid experiences in flowing from the individual supply port 39*a* to the individual collection port 39*b* is reduced, which enables smooth liquid circulation.

Next, the configuration of and a method for manufacturing the liquid ejection head 1 according to the present embodiment are described in more concrete terms through a first example and a second example. In the following description, to clarify the characteristics of these examples, a comparative example to these examples is described first, and then each of the first and second examples is described next.

Comparative Example

The configuration of and a method for manufacturing a liquid ejection head 100 of a comparative example to the examples are described with reference to FIGS. 3A to 3E and FIGS. 4A and 4B. FIGS. 3A to 3E are sectional diagrams showing the manufacturing method of the comparative example. FIG. 4A is a partial sectional view of the liquid ejection head of the comparative example, and FIG. 4B is a plan view thereof.

Figure 3A:
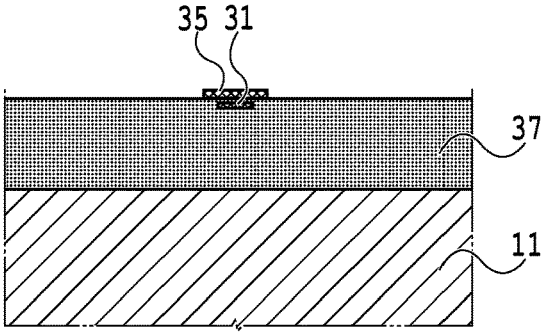
FIGS. 3A to 3E are partial sectional views showing a method for manufacturing a liquid ejection head of a comparative example.
Figure 4A:
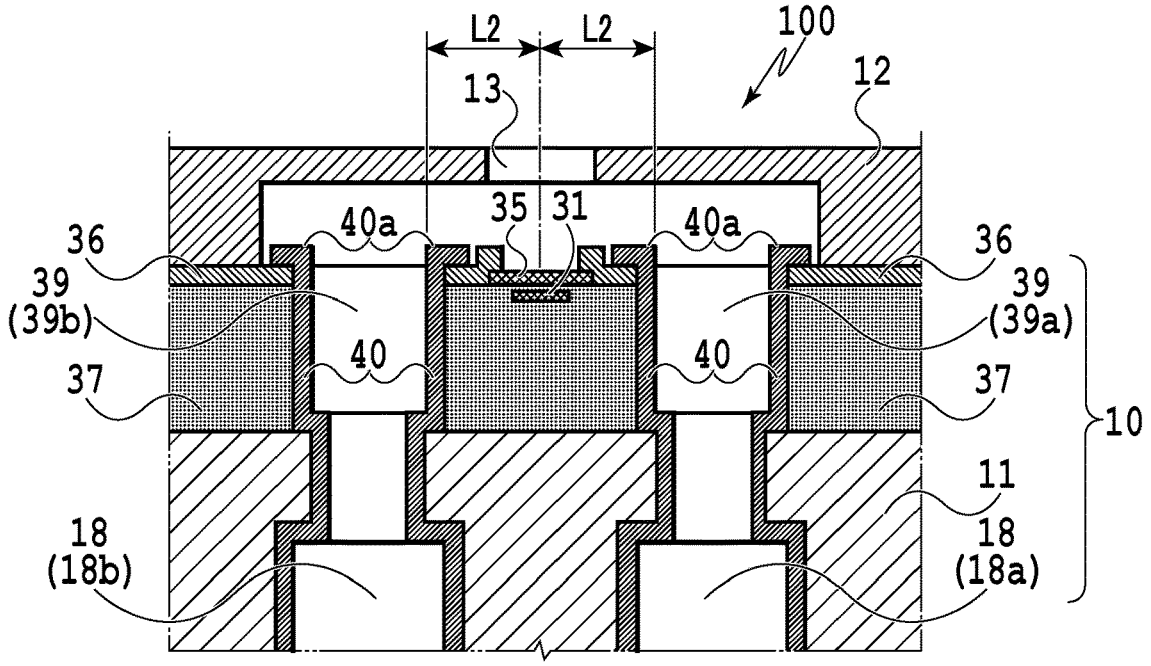
FIGS. 4A and 4B are a partial sectional view and a partial plan view, respectively, of the liquid ejection head of the comparative example.
Figure 4B:
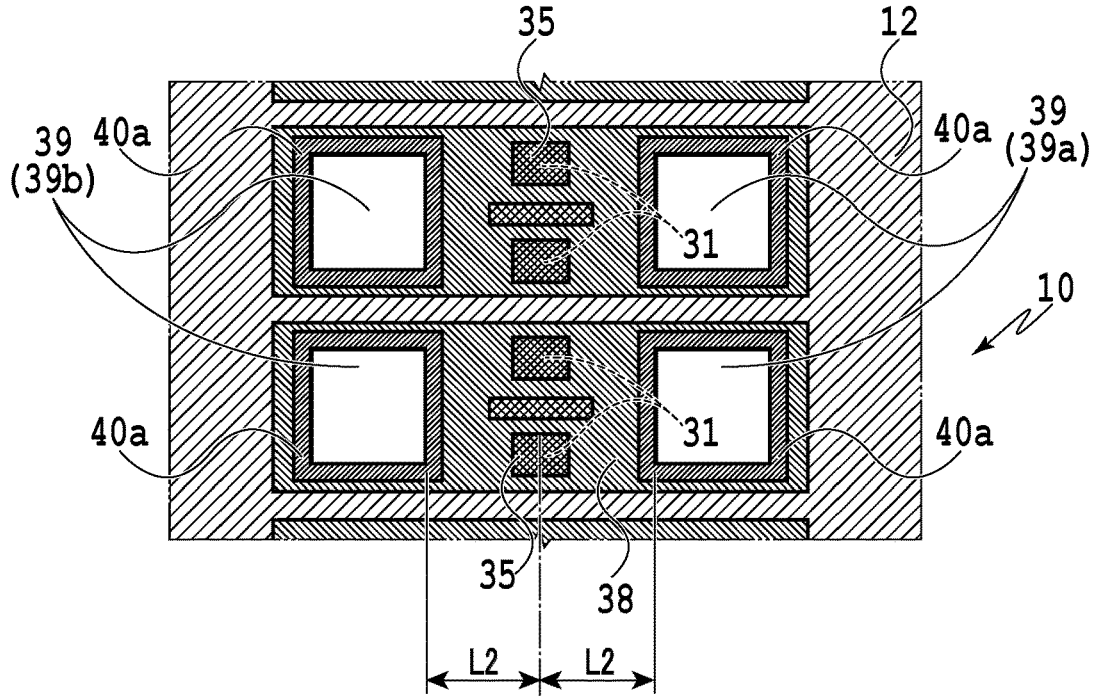

FIG. 3A shows a state where the interlayer insulating film 37 and the ejection elements 31 are formed on the substrate 11 and also the cavitation-resistant layer 35 is formed at positions facing the ejection elements 31. The process for forming the stack structure shown in FIG. 3A is now described.

An interlayer insulating film 37 made of silicon oxide (SiO) and 1 to 2 μm thick was formed on a substrate 11 having driving elements (not shown) for driving ejection elements 31 and wiring (not shown) for driving the driving elements. Next, openings were formed in parts of the interlayer insulating film 37 using dry etching to form through-holes. Next, electrode plugs (not shown) were formed using tungsten to fill the through-holes. Note that the electrode plugs serve to electrically connect the driving elements in the lower layer to the ejection elements 31 to be formed in the upper layer.

After that, the ejection elements 31 were formed using a cermet material made of TaSiN. Specifically, the ejection elements 31 were formed with a thickness of 15 nm and a size of 15 μm in a planar direction. Dry etching using photolithography and chlorine was used for the formation of the ejection element 31. Next, using plasma CVD, an insulating protection film (not shown) made of SiN was formed with a thickness of 200 nm to cover the ejection element 31. Although the film thickness of the insulating protection film was set to 200 nm here from the perspective of insulation, the protection film may have a smaller film thickness as long as it is 100 nm or greater, and further, 100 nm or greater and 500 nm or less from the perspective of heat transfer to liquid.

Next, a cavitation-resistant layer 35 was formed on the insulating protection film. This cavitation-resistance layer was formed by three layers, namely a Ta layer, an Ir layer, and a Ta layer, stacked in this order from the front surface side (the upper surface side in FIG. 3A) of the substrate 11.

These three layers were formed over the entire area of the front surface of the substrate 11 using sputtering, with their thicknesses being 30 nm, 50 nm, and 50 nm in this order from the substrate side. The thickness of the Ir layer is not limited as long as it satisfies the cavitation resistance performance, and is preferably 20 nm or greater. Taking processibility into account additionally, it is more preferable that the thickness of the Ir layer is 20 nm or greater and 300 nm or less. The Ta layer located closer to the front surface of the substrate 11 is disposed to ensure adhesion and is preferably 20 nm or greater. Taking processibility into account additionally, it is more preferable that the thickness of the Ta layer located closer to the front surface of the substrate 11 is 20 nm or greater and 300 nm or less.

Then, the cavitation-resistant layer 35 was subjected to patterning. In this patterning of the cavitation-resistant layer formed on the entire front surface of the substrate 11, portions of the cavitation-resistant layer which were located above the ejection elements 31 were left, and a portion of the cavitation-resistant layer located elsewhere was removed by dry etching. The stack structure shown in FIG. 3A was thus formed.

Figure 3B:
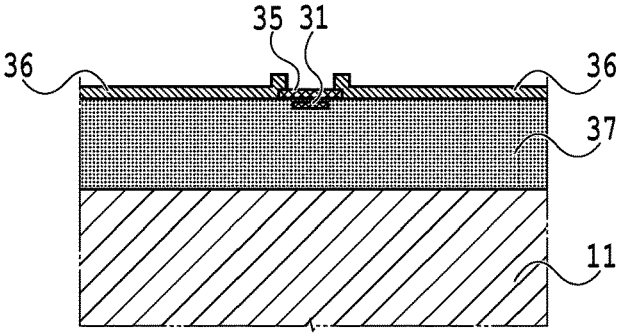
Figure 3C:
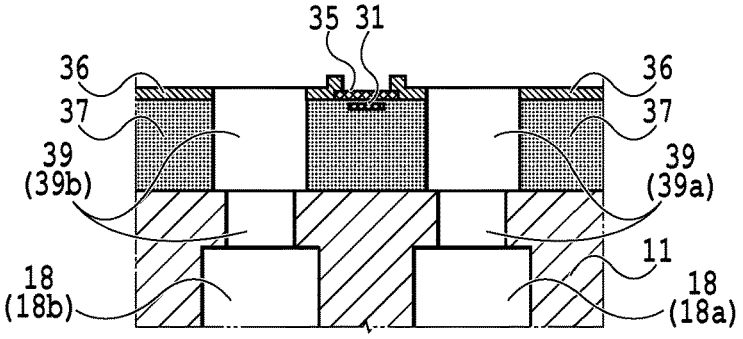

Next, an adhesion improvement layer 36 having an adhesive property with respect to the ejection port formation member 12 was formed using CVD on the entire surface of the interlayer insulating film 37, with a thickness of 150 nm (see FIG. 3B). In this comparative example, a SiOCN film was used as the adhesion improvement layer, but other films such as a SiC or SiCN film may be used instead. Next, dry etching was performed to remove the adhesion improvement layer 36 above the ejection elements 31 and also remove the Ta layer which is located at an outermost surface among the above-described three layers constituting the cavitation-resistant layer 35 so that the Ir film may appear at the outermost surface. Also, openings were formed at locations where electrode pad portions were to be formed, and in the openings thus formed, Au pad portions (not shown) to be electrically connected to the ejection elements 31 were formed.

Next, dry etching was performed to form the individual ports 39 (the individual supply ports 39*a* and the individual collection ports 39*b*) in the interlayer insulating film 37 and the substrate 11, from the front surface (the upper surface in FIG. 3C) of the interlayer insulating film 37. Further, dry etching was used to form the liquid flow channels 18 (the liquid supply flow channel 18*a* and the liquid collection flow channel 18*b*) communicating with the individual ports 39 (the individual supply ports 39*a* and the individual collection ports 39*b*), respectively, from the back surface of the substrate 11 (see FIG. 3C).

Thereafter, using ALD, a titanium oxide (TiO) film 40 resistant to liquid such as ink was formed with a thickness of 100 nm on exposed portions in the substrate 11 and the interlayer insulating film 37. In other words, the TiO film 40 was formed on the back surface of the substrate 11, the inner surfaces of the liquid flow channels 18, the inner surfaces of the individual ports 39, and the front surface of the interlayer insulating film 37.

Figure 3D:
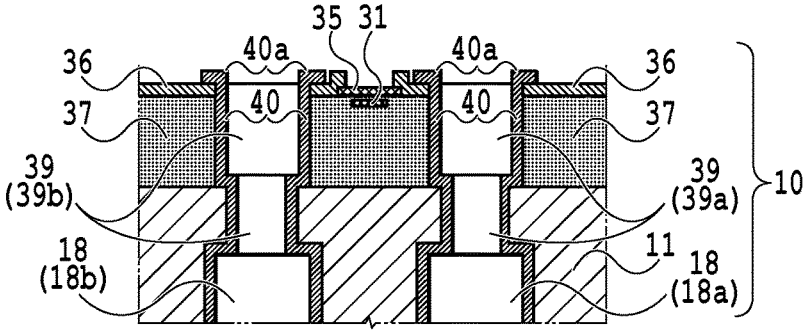

The TiO film 40 formed on the substrate 11 and the interlayer insulating film 37 was removed by wet etching using buffered hydrofluoric acid, except for the portions of the TiO film 40 formed on the inner surfaces of the individual ports 39 and the inner surfaces of the liquid flow channels 18. This wet etching was performed to form overlap portions 40*a* where the TiO film 40 overlaps with the adhesion improvement layer 36 formed on the front surface of the interlayer insulating film 37 by a distance of 5 μm, to make sure to leave the TiO film 40 formed on the inner surfaces of the individual ports 39. FIG. 3D shows this state. From the perspective of adhesion between the adhesion improvement layer 36 and the TiO film 40 and the perspective of manufacturing tolerance, it is necessary for the TiO film 40 to have the 5-μm-wide (distance) overlap portions 40*a*. The ejection element substrate 10 was thus formed.

Figure 3E:
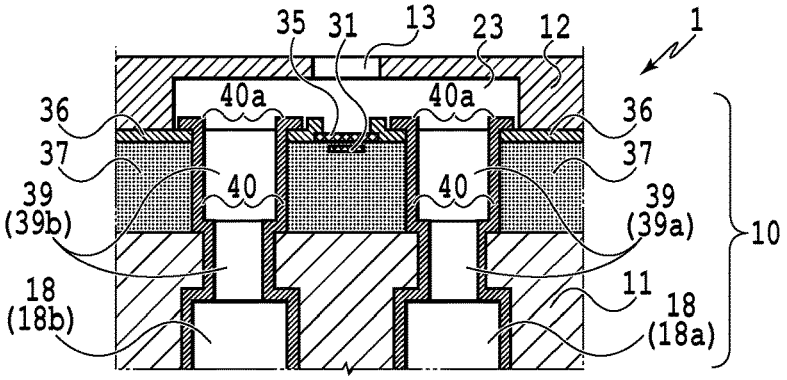

After that, as shown in FIG. 3E, the ejection port formation member 12 was provided on the ejection element substrate 10. For the ejection port formation member 12 used in this comparative example and the first and second examples to be described below, a stack film having a stack of a plurality of negative-type photosensitive resin films was used. Specifically, after a plurality of resin layers were formed on a film, the film was attached to a base material having irregularities, and then exposure and development were performed to form the ejection port formation member 12. Particularly for the negative-type photosensitive resin layer to be in direct contact with the ejection element substrate 10, a resin layer containing polyol was used. This resin layer has a good adhesive property with respect to silicon compounds such as SiOCN used in this comparative example and the examples. However, the resin layer does not have a good adhesive property with respect to a film made of a metal or a metal oxide, and may peel off at the interface after being immersed in ink at high temperatures. Thus, this comparative example has a configuration such that the ejection port formation member 12 and the TiO film 40 are not in direct contact with each other. The liquid ejection head 100 of the comparative example is thus fabricated.

As shown in FIGS. 4A and 4B, the comparative example has the overlap portions 40*a* formed on the front surface (the upper surface in FIGS. 4A and 4B) of the ejection element substrate 10, around the opening portions of the individual ports 39. These overlap portions 40*a* need to be 5 μm in width as described earlier, and therefore the individual ports 39 need to be formed at positions considering this width. As a result, a distance L2 from each individual port 39 to the ejection elements 31 is increased, which leads to upsizing of the ejection element substrate 10 and, by extension, upsizing of the liquid ejection head 1. In addition, the increase in the distance L2 may increase the liquid flow resistance and/or complicate the manufacturing process due to the need for forming the overlap portions.

First Example

Figure 5A:
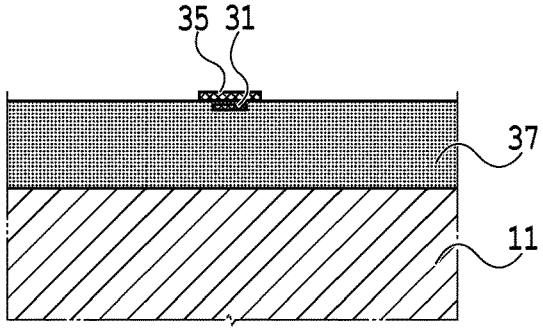
FIGS. 5A to 5E are partial sectional views showing a method for manufacturing a liquid ejection head of a first example.
Figure 5B:
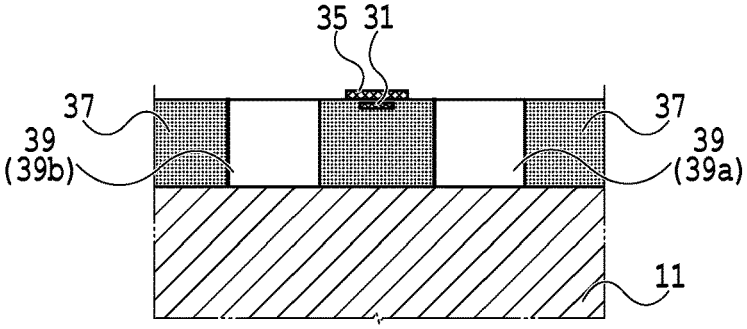

Next, the first example of the present invention is described. The following describes a method for manufacturing the liquid ejection head 1 shown in FIGS. 2A and 2B step by step, based on the manufacturing steps shown in FIGS. 5A to 5E. FIG. 5A is a sectional view showing a state after patterning of the cavitation-resistant layer 35 on the substrate 11. Steps up to this patterning of the cavitation-resistant layer 35 are the same as those in the comparative example, and are therefore not described here.

In this example, after the patterning of the cavitation-resistant layer 35, Au pad portions shown in FIG. 1 were formed (they are not shown in FIGS. 5A to 5E). Then, dry etching was performed only on the interlayer insulating film 37 from the front surface side (the upper surface side in FIG. 5A) of the interlayer insulating film 37 to form opening portions 391, which correspond to part of the individual ports 39 (the individual supply ports 39*a* and the individual collection ports 39*b*) shown in FIGS. 2A and 2B (see FIG. 5B).

Figure 5C:
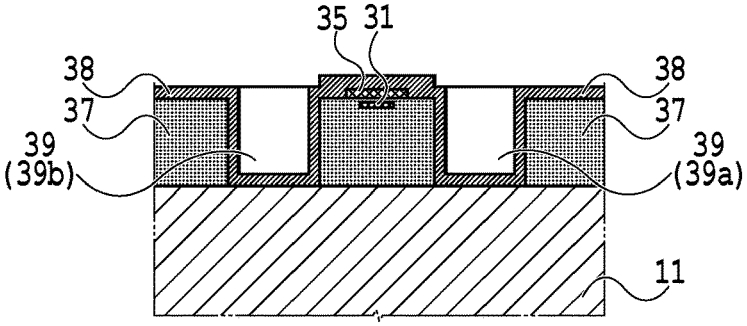

After the formation of the opening portions 391 of the individual ports 39, as shown in FIG. 5C, a continuous liquid-resistant insulating film 38 was formed using plasma CVD on the front surface (the upper surface in FIG. 5C) of the interlayer insulating film 37 and the entire inner surfaces (the side and bottom surfaces) of the opening portions 391. In this example, as the liquid-resistant insulating film 38, a 150-nm-thick SiOCN film was formed on the front surface of the interlayer insulating film 37. In this event, a film with a thickness of 100 nm or greater was formed on the inner surfaces (the side and bottom surfaces) of the opening portions 391 of the individual ports 39, the film being continuous with the SiOCN film formed on the front surface of the interlayer insulating film 37. This enables protection of the interlayer insulating film 37 from liquid such as ink. In other words, it is possible to help prevent contact between the interlayer insulating film 37 and liquid and therefore elution of the interlayer insulating film 37. The liquid-resistant insulating film 38 may be formed of a SiCN or SiOC film or a stack film thereof. Having a good adhesive property with respect to a resin forming the ejection port formation member 12, the liquid-resistant insulating film 38 formed of a SiOCN, SiCN, or SiOC film or a stack film thereof also serves as an adhesion improvement layer. Thus, there is no need to form an adhesion improvement layer additionally in another step.

Although a 150-nm-thick SiOCN film was formed on the surface of the interlayer insulating film 37 in the formation of the liquid-resistant insulating film 38 in this example, the formation of the liquid-resistant insulating film 38 is not necessarily limited to this example. The formation of the liquid-resistant insulating film 38 may be carried out so that a SiOCN film with a thickness of 100 nm or greater may be formed on the inside of the individual ports 39. In addition, although plasma CVD was used to form the liquid-resistant insulating film 38, other film formation methods, such as ALD, may be used instead. If the SiOCN film forming the liquid-resistant insulating film 38 contains 5 at. % or greater carbon atoms C, it is possible to drastically decrease film thinning (a decrease in the film thickness) of the liquid-resistant insulating film 38 due to contact with liquid. In this example, the content of carbon atoms C was 10 at. %. The liquid-resistant insulating film 38 was thus formed in this example, continuously covering the front surface of the interlayer insulating film 37 and the inner surfaces of the individual ports 39.

Figure 5D:
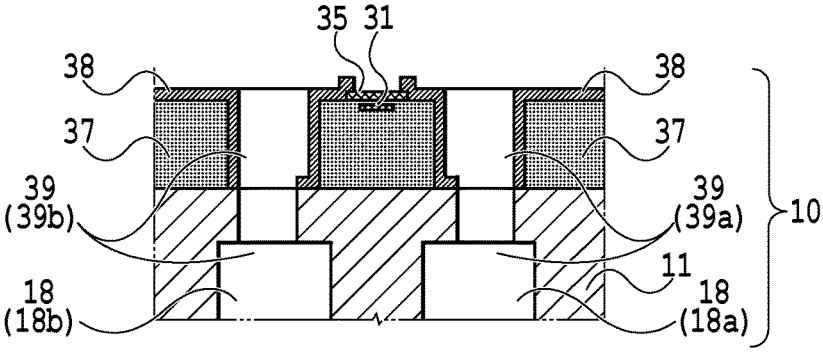
Figure 5E:
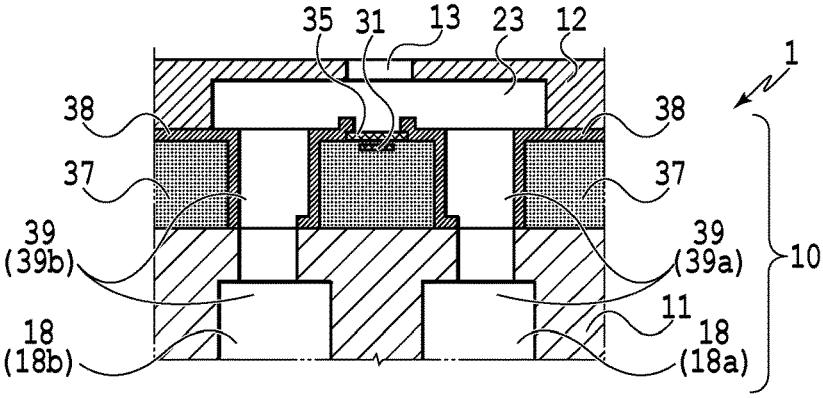

Next, as shown in FIG. 5D, portions of the liquid-resistant insulating film (SiOCN film) 38 and the outermost Ta film of the three layers constituting the cavitation-resistant layer 35 were removed by dry etching, the portions being located above the ejection elements 31. The Ir layer of the cavitation-resistant layer 35 was thereby exposed at these portions. This dry etching was performed using chlorine-based gas under low-bias conditions. This enables the etching to stop at the position where the Ir layer is exposed. Thus, the SiOCN film and the Ta film can be etched successively.

Next, as shown in FIG. 5D, portions of the SiOCN film formed on the bottom surfaces of the opening portions 391 constituting part of the individual ports 39 (the individual supply ports 39*a* and the individual collection ports 39*b*) and portions of the substrate 11 within the individual ports 39 were etched from the front surface side (the upper surface side in FIG. 5D) to from opening portions 392. Further, dry etching was performed from the back surface side (the lower surface side in FIG. 5D) of the substrate 11 to form liquid flow channels 18 (a liquid supply flow channel 18*a* and a liquid collection flow channel 18*b*) communicating with the individual ports 39. The ejection element substrate 10 was thus fabricated.

Next, using a method similar to that in the comparative example, an ejection port formation member 12 was provided on the front surface (the upper surface in FIG. 5D) of the ejection element substrate 10, forming pressure chambers 23 communicating with the individual ports 39 between the ejection element substrate 10 and the ejection port formation member 12. The liquid-resistant insulating film 38 having a good adhesive property with respect to the ejection port formation member 12 is formed as the outermost surface of the ejection element substrate 10. Thus, there is no particular need to consider the adhesion between the ejection port formation member 12 and the ejection element substrate 10 for the provision of the ejection port formation member 12, and the ejection port formation member 12 can be formed at a location where it is needed. In addition, unlike the comparative example, there is no need to form 5-μm overlap portions on the front surface of the ejection element substrate 10. This enables the distance L1 between the ejection elements 31 and the individual ports to be shorter than the distance L2 in the comparative example. This not only makes the configuration of the liquid ejection head 1 compact, but also reduces the liquid flow resistance inside the liquid ejection head 1, which enables higher liquid fluidity.

Second Embodiment

Next, the second example of the present invention is described. The first example above has a configuration such that, in the ejection element substrate 10, only the interlayer insulating film 37 which is liable to elution upon contact with liquid such as ink is covered with the liquid-resistant insulating film 38 such as a SiOCN film. By contrast, the second embodiment has a configuration such that the inner surfaces of the liquid flow channels 18 (the liquid supply flow channel 18*a* and the liquid collection flow channel 18*b*) formed in the substrate 11 are also covered with a film with liquid resistance.

Figure 6:
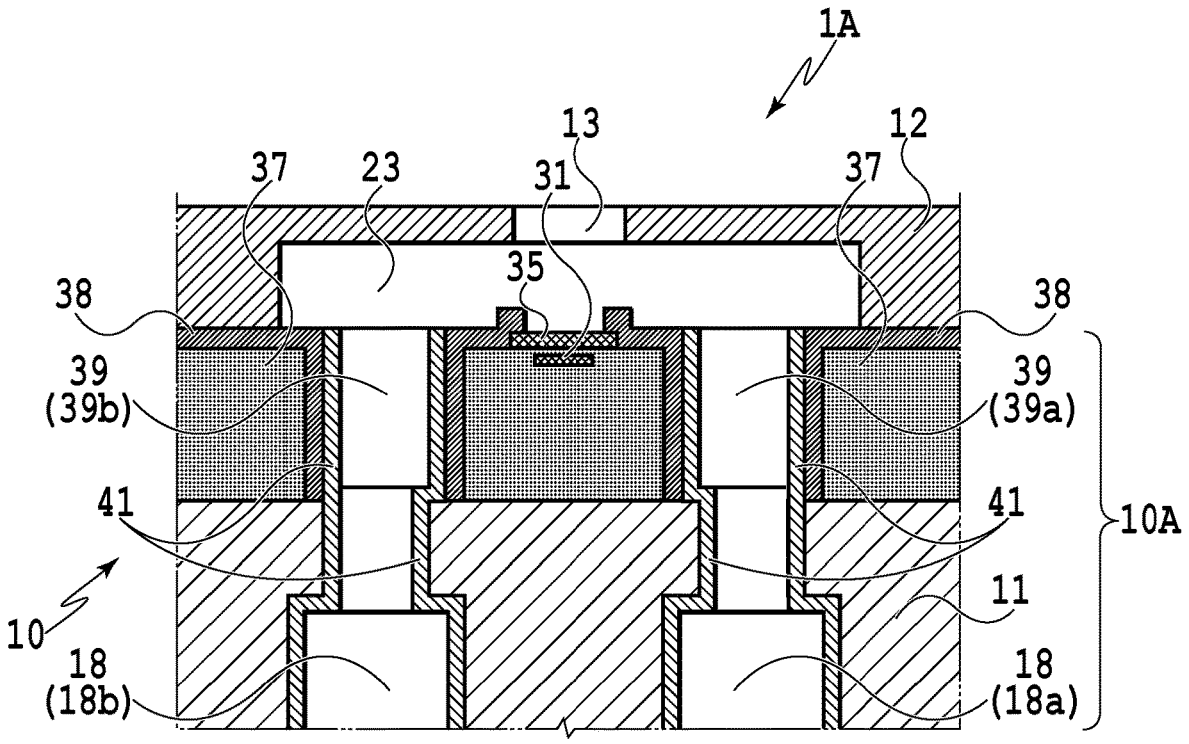
FIG. 6 is a partial sectional view showing a liquid ejection head of a second example.

FIG. 6 is a sectional view showing a liquid ejection head 1A of the second example. Like the first example, the processing shown in FIGS. 5A to 5D was performed in this example as well. Specifically, using plasma CVD, a liquid-resistant insulating film 38 was formed continuously on the front surface of the interlayer insulating film 37 and the inner surfaces of the opening portions 391 which are part of the individual ports 39. After that, the liquid-resistant insulating film 38 and the substrate 11 within the opening portions 391 were etched from the front surface side of the interlayer insulating film 37 to form the individual ports 39 (the individual supply ports 39*a* and the individual collection ports 39*b*), and then, liquid flow channels 18 were formed by dry-etching of the substrate 11 from the back surface side thereof.

The processing up to FIG. 5D is thus completed, and next, in this example, a liquid-resistant TiO film 41 was formed using ALD with a thickness of 100 nm not only in the individual ports 39 and the liquid flow channels 18, but also on the front surface and the back surface of the substrate 11. Then, the TiO film 41 formed above the front surface of the interlayer insulating film 37 was removed from the front surface side of the interlayer insulating film 37 using etch-back to expose the liquid-resistant insulating film 38 on the front surface of the interlayer insulating film 37. Since the TiO film formed in the individual ports 39 and the liquid flow channels 18 are difficult to etch, the TiO film 41 is unremoved and remains as shown in FIG. 6. Using etch-back to remove the TiO film 41 allows the same layout design as in the first example to be obtained. The formation of an ejection element substrate 10A of this example is thus completed.

Next, using a method similar to the comparative example, an ejection port formation member 12 was provided on the front surface of the ejection element substrate 10A to form pressure chambers 23 communicating with the individual ports 39 between the ejection element substrate 10A and the ejection port formation member 12. The liquid ejection head 1A of the second example was thus completed.

Like the first example, this example makes it possible to have a shorter distance between the individual ports 39 and the ejection elements 31 and therefore to make the liquid ejection head 1A compact. Furthermore, this example allows not only the interlayer insulating film 37 but also the substrate 11 to be protected from liquid, which makes it possible to fabricate the liquid ejection head 1A with higher reliability.

Further, since the formation of the TiO film 41 using ALD and the etch-back are additionally performed in the second example, part of the substrate 11 can also be covered with a liquid-resistant film, which makes it possible to fabricate the liquid ejection head 1A with higher reliability.

(Comparisons Among First and Second Examples and Comparative Example)

Now, comparisons are made among the first example, the second example, and the comparative example. As shown in FIG. 4B, in the comparative example, the approximately-5-μm-wide overlap portions 40*a* of the liquid-resistant film (the TiO film 40) need to be provided around the individual ports 39 on the front surface side of the ejection element substrate 10. By contrast, in the first and second examples, as shown in FIGS. 2A and 2B and 6, there is no need to provide such overlap portions of a liquid-resistant film around the individual ports 39. Thus, these example each have a configuration such that the widths (5 μm) of the overlap portions 40*a* needed in the comparative example are eliminated, and the individual ports 39 are formed at positions closer to the ejection element 31 by those widths. Specifically, the distance L1 between the ejection elements 31 and the individual ports 39 in these examples is shorter than the distance L2 between the ejection elements 31 and the individual ports 39 in the comparative example at least by the width of the overlap portion 40*a* (5 μm). Due to this configuration, the first and second examples can obtain the liquid ejection heads 1 and 1A that are smaller in size and in liquid flow resistance than the comparative example.

While the comparative example uses two kinds of films, namely the adhesion improvement layer 36 and the TiO film 40, to protect the interlayer insulating film 37, the first example uses only one kind of film, namely the liquid-resistant insulating film 38, for protection against liquid. This configuration enables simplification of the manufacturing process and reduction in the manufacturing costs.

Furthermore, the second example forms the TiO film 41 using ALD and performs etch-back to cause the TiO film 41 to protect the substrate 11 from liquid as well, which makes it possible to fabricate a liquid ejection head with higher reliability.

Other Embodiments

In the above embodiment and examples, the individual supply ports 39*a* and the individual collection ports 39*b* are formed at both sides of the ejection elements 31 so that liquid supplied from the individual supply ports 39*a* to the pressure chambers 23 but not ejected through the ejection ports 13 may be collected from the individual collection ports 39*b*. However, the present invention is not limited to such a configuration. The present invention is applicable to a liquid ejection head having a configuration such that liquid is supplied from two individual ports provided at both sides of the ejection element to the pressure chambers. The present invention is also applicable to a liquid ejection head having a configuration such that an individual port communicating with a pressure chamber is formed only on one side of the ejection element so that liquid is supplied to the pressure chamber from the one individual port.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-120678 filed Jul. 14, 2020, which is hereby incorporated by reference wherein in its entirety.

What is claimed is:

1. A liquid ejection head including a liquid ejection head substrate provided with an ejection element that generates energy for ejecting liquid, an ejection port formation member in which an ejection port through which to eject the liquid is formed, and a liquid chamber, which is formed between the liquid ejection head substrate and the ejection port formation member and houses liquid to be ejected through the ejection port, the liquid ejection head substrate comprising:

a substrate;

an insulating film stacked on the substrate to insulate the ejection element;

a communication port formed in the substrate and the insulating film in such a manner as to communicate with the liquid chamber; and a liquid-resistant insulating film that has an adhesive property with respect to the ejection port formation member and is formed only of (i) a first, which covers a surface of the insulating film at a side where the ejection port formation member is provided and is partially in contact with the ejection port formation member; and ii) a second portion, which covers an inner surface of the communication port formed in the insulating film, the first portion and the second portion being provided in such a manner as to be continuous with each other.

2. The liquid ejection head according to claim 1, wherein the communication port includes a first opening portion, which is formed in the insulating film, and a second opening portion, which communicates with a liquid flow channel formed in the substrate, and wherein the liquid-resistant insulating film is formed on an inner surface of the first opening portion.

3. The liquid ejection head according to claim 1, wherein the liquid-resistant insulating film is an insulating film containing carbon atoms.

4. The liquid ejection head according to claim 1, wherein the liquid-resistant insulating film is an insulating film containing 5% or greater carbon atoms.

5. The liquid ejection head according to claim 1, wherein the liquid-resistant insulating film is formed of a silicon carbonitride (SiCN) film, a silicon oxycarbonitride (SiOCN) film, a silicon oxycarbide (SiOC) film, or a stack film thereof.

6. The liquid ejection head according to claim 1, wherein the ejection port formation member is made of resin.

7. The liquid ejection head according to claim 1, wherein the ejection port formation member is formed of a stack film, which is a stack of a plurality of negative-type photosensitive resin layers.

8. The liquid ejection head according to claim 7, wherein out of the resin layers constituting the stack film, a resin layer in contact with the liquid-resistant insulating film contains a polyol.

9. The liquid ejection head according to claim 2, wherein the first opening portion and the second opening portion are formed at least at one side of the ejection element.

10. The liquid ejection head according to claim 9, wherein:

the first opening portion and the second opening portion are formed at both sides of the ejection element;

the first opening portion and the second opening portion formed at one of the sides of the ejection element form a supply port for supplying liquid to the liquid chamber; and the first opening portion and the second opening portion formed at the other one of the sides of the ejection element form a collection port for collecting liquid from the liquid chamber.

11. The liquid ejection head according to claim 10, wherein a second liquid-resistant insulating film is formed on an inner surface of the second opening portion and an inner surface of the liquid flow channel.

12. The liquid ejection head according to claim 11, wherein the second liquid-resistant insulating film covers the liquid-resistant insulating film formed on the inner surface of the first opening portion.

13. The liquid ejection head according to claim 11, wherein the liquid-resistant insulating film is formed of a silicon carbonitride (SiCN) film, a silicon oxycarbonitride (SiOCN) film, a silicon oxycarbide (SiOC) film, or a stack film thereof, and the second liquid-resistant insulating film is formed of a titanium oxide (TiO) film.

14. A liquid ejection head including a liquid ejection head substrate provided with an ejection element that generates energy for ejecting liquid, an ejection port formation member in which an ejection port through which to eject the liquid is formed, and a liquid chamber, which is formed between the liquid ejection head substrate and the ejection port formation member and houses liquid to be ejected through the ejection port, the liquid ejection head substrate comprising:

a substrate;

an insulating film stacked on the substrate to insulate the ejection element;

a communication port formed in the substrate and the insulating film in such a manner as to communicate with the liquid chamber; and a coating film that is formed only of (i) a first portion, which covers a surface of the insulating film at a side where the ejection port formation member is provided and is partially in contact with the ejection port formation member, and (ii) a second portion, which covers an inner surface of the communication port formed in the insulating film, the first portion and the second portion being provided in such a manner as to be continuous with each other, the coating film being formed of a silicon compound containing carbon atoms.

15. The liquid ejection head according to claim 14, wherein the coating film contains 5 % or greater carbon atoms.

16. The liquid ejection head according to claim 14, wherein the coating film is formed of a silicon carbonitride (SiCN) film, a silicon oxycarbonitride (SiOCN) film, a silicon oxycarbide (SiOC) film, or a stack film thereof.

17. The liquid ejection head according to claim 14, wherein the ejection port formation member is made of resin.

18. A method for manufacturing a liquid ejection head including a liquid ejection head substrate in which an ejection element that generates energy for ejecting liquid is formed, an ejection port formation member in which an ejection port through which to eject liquid is formed, and a liquid chamber, which is formed between the liquid ejection head substrate and the ejection port formation member and houses liquid to be ejected through the ejection port, the method comprising:

stacking, on a substrate, an insulating film that insulates the ejection element;

forming an opening portion in the insulating film at a side of the ejection element;

forming a liquid-resistant insulating film that has an adhesive property with respect to the ejection port formation member and continuously covers only a surface of the insulating film at a side where the ejection port formation member is provided and an inner surface of the opening portion; and providing the ejection port formation member so that the ejection port formation member is in contact with a part of the liquid-resistant insulating film.

19. The method for manufacturing a liquid ejection head according to claim 18, wherein the liquid-resistant insulating film is an insulating film containing carbon atoms.

20. The method for manufacturing a liquid ejection head according to claim 18, wherein the liquid-resistant insulating film is formed of a silicon carbonitride (SiCN) film, a silicon oxycarbonitride (SiOCN) film, a silicon oxycarbide (SiOC) film, or a stack film thereof.

* * * * *